US010589830B2

(12) United States Patent
Borel et al.

(10) Patent No.: US 10,589,830 B2
(45) Date of Patent: Mar. 17, 2020

(54) MARINE VEHICLE THRUSTER CONTROL METHOD

(71) Applicant: THALES, Courbevoie (FR)

(72) Inventors: Christophe Borel, Sophia Antipolis (FR); Jean-Philippe Brunet, Sophia Antipolis (FR); Benoît Theckes, Sophia Antipolis (FR); Cyril Bouyer, Sophia Antipolis (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/065,798

(22) PCT Filed: Dec. 22, 2016

(86) PCT No.: PCT/EP2016/082506
§ 371 (c)(1),
(2) Date: Jun. 23, 2018

(87) PCT Pub. No.: WO2017/109149
PCT Pub. Date: Jun. 29, 2017

(65) Prior Publication Data

US 2019/0009872 A1 Jan. 10, 2019

(30) Foreign Application Priority Data

Dec. 23, 2015 (FR) ..... 15 02682

(51) Int. Cl.
*B63G 8/08* (2006.01)
*B63G 8/16* (2006.01)
(Continued)

(52) U.S. Cl.
CPC ..... *B63G 8/16* (2013.01); *B63H 3/002* (2013.01); *B63H 5/10* (2013.01); *B63H 2025/425* (2013.01)

(58) Field of Classification Search
CPC . B63H 3/002; B63H 3/02; B63H 3/04; B63H 3/06; B63H 5/10; B63H 25/42;
(Continued)

(56) References Cited

U.S. PATENT DOCUMENTS 2,727,485 A * 12/1955 Combs ..... B63G 8/08 114/321
3,130,066 A * 4/1964 Brady ..... B05B 3/1064 427/484

(Continued)

FOREIGN PATENT DOCUMENTS

EP 0 215 629 A2 3/1987

*Primary Examiner* — Daniel V Venne
(74) *Attorney, Agent, or Firm* — Baker & Hostetler LLP

(57) ABSTRACT

A method for controlling a thruster of a marine vehicle includes a body and a thruster mounted on the body of the vehicle, the vehicle being at least partially immersed in a liquid and moving with respect to the liquid along an axis of displacement in a direction of displacement and rotating about at least one axis of rotation perpendicular to the axis of displacement with a rotational speed, the thruster including an upstream propeller and a downstream propeller along the axis of displacement in the direction of displacement. The method including a stabilization step, in which the thruster is controlled such that the main axis of the upstream flow generated by the upstream propeller at a given instant t is an estimated main axis on which a position of a center of the downstream propeller, situated substantially on the axis of rotation of the downstream propeller, is estimated to be situated at a later instant t+dt at which the flow generated by the upstream propeller at the given instant t reaches the downstream propeller, the estimated main axis depending on the rotational speed of the vehicle.

35 Claims, 5 Drawing Sheets

(51) Int. Cl.
*B63H 3/00* (2006.01)
*B63H 5/10* (2006.01)
*B63H 25/42* (2006.01)

(58) Field of Classification Search
CPC ..... B63H 25/46; B63H 2025/42; B63H 2025/425; B63H 2025/46; B63G 8/16
USPC ..... 440/1, 38, 40, 47
See application file for complete search history.

(56) References Cited

U.S. PATENT DOCUMENTS 3,131,066 A * 4/1964 Mitzelfelt ..... A22C 7/0007 426/140
3,703,211 A * 11/1972 Bernaerts ..... B63H 1/14 440/79
4,648,345 A * 3/1987 Wham ..... B63G 8/16 114/338
8,783,202 B1 * 7/2014 Lowery ..... B63H 1/10 114/330
8,919,274 B1 12/2014 Chen et al.
9,022,738 B1 5/2015 Silberg et al.

* cited by examiner

MARINE VEHICLE THRUSTER CONTROL METHOD

CROSS-REFERENCE TO RELATED APPLICATIONS

This application is a National Stage of International patent application PCT/EP2016/082506, filed on Dec. 22, 2016, which claims priority to foreign French patent application No. FR 1502682, filed on Dec. 23, 2015, the disclosures of which are incorporated by reference in their entirety.

FIELD OF THE INVENTION

The present invention relates to the propulsion and to the maneuvering of marine vehicles comprising a thruster comprising two propellers.

BACKGROUND

The invention applies most particularly to underwater vehicles comprising a vectored thruster with two propellers. A thruster is said to be a vectored thruster when it is able to be controlled in such a way as to produce a thrust or propulsive force that is able to be oriented over $4\pi$ steradians. What is termed vectored propulsion of an underwater vehicle is in opposition to conventional propulsion, in which the orientation of fins brings about a modification in the lift generated by the flow of fluid surrounding the fins. The force generated by the fluid on the fins allows the vehicle to be oriented in the desired direction. One well-known limit of this form of propulsion is the requirement to generate a significant flow of fluid around the vehicle in order to bring about a change in lift of the fins that allows the attitude of the vehicle to be changed, that is to say in order to allow the underwater vehicle to be maneuvered. If this flow is too weak, then the effectiveness of the fins drops inversely with the square of the speed of the flow, until it becomes zero for a zero flow speed. In other words, it is not possible using conventional propulsion to orient the vehicle in a desired direction without significant displacement of the vehicle when the flow of fluid is zero. Moreover, the fins generate a drag proportional to the square of the speed that opposes the displacement and that therefore consumes energy, the more so the more the fins are invoked. The method for controlling vectored propulsion presented in the present patent allows the vehicle to dispense with conventional directional fins, and therefore to significantly reduce the hydrodynamic drag of the vehicle. Vectored propulsion of the type with two propellers exhibits numerous theoretical advantages, in particular increased mobility, simplification of the architecture (e.g. by eliminating the fins), and an increase in the endurance of the vehicle (by reducing the hydrodynamic drag). This absence of fins other than the blades of the propellers facilitates the implementation of what is termed a "flush" hydrodynamic vehicle, that is to say from which no appendage protrudes, thereby allowing it for example to fit easily in a tube and avoiding damaging the fins when berthing.

However, controlling this type of thruster encounters numerous difficulties, in particular when turning.

SUMMARY OF THE INVENTION

One aim of the invention is to propose a method for controlling a marine vehicle comprising a thruster with two propellers, allowing the path of the vehicle to be controlled in particular when turning.

To this end, one subject of the invention is a method for controlling, that is to say commanding, a thruster of a marine vehicle comprising a body and a thruster mounted on the body of the vehicle, the vehicle being at least partially immersed in a liquid and moving with respect to the liquid along an axis of displacement in a direction of displacement and rotating about at least one axis of rotation perpendicular to the axis of displacement with a rotational speed, the thruster comprising an upstream propeller and a downstream propeller along the axis of displacement in the direction of displacement. The method comprises a stabilization step, in which the thruster is controlled, that is to say commanded, such that the main axis of the upstream flow generated by the upstream propeller at a given instant is an estimated main axis on which a position of a center of the downstream propeller, situated substantially on the axis of rotation of the downstream propeller, is estimated to be situated at an instant later than the given instant at which the flow generated by the upstream propeller at the given instant reaches the downstream propeller.

Advantageously, the estimated main axis depends on the rotational speed of the vehicle.

The method advantageously comprises at least one of the following features, taken alone or in combination:

the estimated main axis depends on a speed of displacement of the vehicle with respect to the liquid along the axis of displacement;

the estimated main axis is determined from the rotational speed of the vehicle and from a speed of the liquid entrained by the flow generated by the upstream propeller, in relation to the body of the vehicle;

the estimated main axis is determined from the distance between the centers of the two propellers;

the estimated main axis is determined from the acceleration of the vehicle along the axis of displacement;

the method comprises the following pair of steps implemented at a predetermined interval of time:

- a determination step, comprising a step of determining the current rotational speed of the vehicle,
- the step of stabilization on the basis of the current rotational speed;

the determination step comprises a step of determining the current speed of the liquid entrained by the upstream flow generated by the upstream propeller with respect to the body of the vehicle;

in the stabilization step, the thruster is controlled such that each of the two propellers generates a flow that is directed downstream;

the thruster comprises two counter-rotating propellers with variable collective and cyclic pitches;

the axes of rotation of the two propellers are substantially coincident;

in the stabilization step, in order that the thruster exerts a radial thrust so as to rotate the vehicle about an axis perpendicular to the axis of displacement, the thruster is controlled such that the downstream propeller generates a flow that is not rotationally symmetrical about the axis of displacement;

in order that the thruster generates a thrust having a radial component exerted in a direction dr, forming, about the axis of rotation of the downstream propeller, a first angle $\alpha$ with a reference direction, the thruster is controlled such that the downstream propeller has a cyclic pitch comprising a cyclic angle $\theta$ given by the following formula:

$$\theta=\alpha-\varphi$$

where the cyclic phase φ is the angle formed, about the axis of rotation of the downstream propeller, between the thrust generated by the downstream propeller and the cyclic angle of the downstream propeller, the cyclic angle of a propeller being the angle formed about the axis of rotation of the downstream propeller x between the direction in which the cyclic pitch angle of the propeller is at a maximum and the reference direction;

the cyclic phase is determined in a calibration step.

The invention also relates to a vehicle comprising a body and a thruster mounted on the body, the vehicle being intended to be at least partially immersed in a liquid and to move with respect to the liquid along an axis of displacement in a direction of displacement and to rotate about at least one axis of rotation perpendicular to the axis of displacement with a rotational speed, the thruster comprising an upstream propeller and a downstream propeller along the axis of displacement in the direction of displacement, the control device being able to implement the stabilization step according to the invention such that the main axis of the upstream flow generated by the upstream propeller at an instant is the estimated main axis, the control device comprising a control unit configured to determine the estimated main axis and an actuation device configured to configure the upstream propeller such that the main axis of the upstream flow generated by the upstream propeller at an instant is an estimated main axis.

Advantageously, the control unit is configured to determine the estimated main axis from the rotational speed of the vehicle and from the speed of the liquid entrained by the flow generated by the upstream propeller with respect to the body of the vehicle.

The invention also relates to a control device able to implement the method according to the invention, the control device comprising a control unit configured to determine the estimated main axis in the stabilization step, and an actuation device configured to configure the upstream propeller such that the main axis of the upstream flow generated by the upstream propeller at an instant is the estimated main axis (xe).

The invention also relates to a propulsion system comprising the control device and the thruster.

BRIEF DESCRIPTION OF THE DRAWINGS

Other features and advantages of the invention will become apparent on reading the detailed description that follows, given by way of non-limiting example and with reference to the appended drawings, in which.

DETAILED DESCRIPTION

Figure 1:
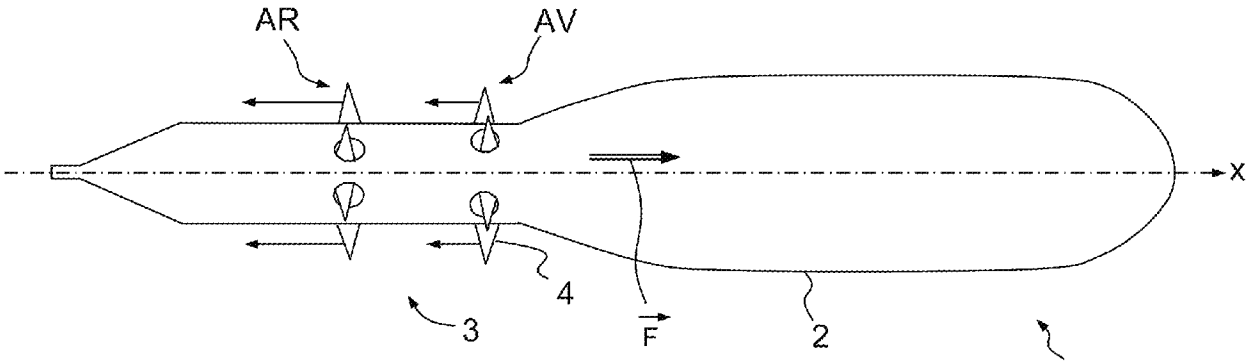
FIG. 1 schematically shows a plan view of an underwater vehicle advancing along an axis x, FIG. 2 schematically shows a plan view of an underwater vehicle reversing along an axis x, FIG. 3 schematically shows a plan view of an underwater vehicle at an instant t, advancing along the axis x and comprising a thruster configured to exert a radial thrust on the vehicle so as to rotate the vehicle to the left, the upstream propeller generating a flow directed toward the position of the center of the downstream propeller at the instant t, FIG. 4 schematically shows, with more precision, the flows and propellers of FIG. 3 at the instant t, and the estimated position of the downstream propeller at an instant t+dt, FIG. 5 schematically shows, with more precision, the propellers of FIG. 3, and the estimated position of the downstream propeller at an instant t+dt and the flows generated by the two propellers at the instant t, the upstream propeller generating, at the instant t, a flow directed toward an estimated position of the center of the downstream propeller at an instant t+dt, FIG. 6 schematically shows, at an instant t+dt, a vehicle of which the flows generated by the propellers at the instant t are those of FIG. 5. The lines of the flow generated by the upstream propeller at the instant t are shown in FIG. 6, in a reference frame linked to the vehicle, until this flow reaches the downstream propeller. The lines of the flow generated by the downstream propeller at the instant t are also shown.

From one figure to another, the same elements bear the same references.

The invention proposes a method for controlling, that is to say for commanding, a thruster of a marine vehicle. The method applies most particularly to underwater vehicles intended to move when they are completely immersed in a liquid, in particular water. The invention also applies to land vehicles intended to move on the surface of a liquid while being partially immersed in the liquid. Marine vehicles may be autonomous vehicles with pilots (humans) on board, or drones without a pilot on board, such as remotely operated vehicles or ROVs, or autonomous marine vehicles such as autonomous underwater vehicles or AUVs. As a result, the control method according to the invention may be implemented by an on-board or remote operator (pilot) or by an autonomous control device.

This method applies to vehicles comprising a vectored thruster comprising two counter-rotating propellers said to have variable collective and cyclic pitches. A propeller with variable collective and cyclic pitch is a propeller of which the pitch angle of the blades is able to be controlled collectively, allowing the thrust to be adjusted along the axis of rotation of the propeller. The collective pitch is defined by a collective pitch angle of the blades. In other words, all of the blades have the same collective pitch angle over the entire revolution of the blades about the axis of rotation of the propeller. It is recalled that the pitch angle of the blades of a propeller is the angle formed between the chord of the blade and the plane of rotation of the propeller along the chosen reference. The plane of rotation of the propeller is a plane of the propeller that is perpendicular to the axis of rotation of the propeller. The pitch angle is also able to be adjusted cyclically, allowing the thrust to be oriented perpendicularly to the axis of rotation of the propeller. The cyclic pitch angle of the blades varies cyclically, that is to say over the course of one revolution about the axis of rotation of the propeller, as a function of the angular positions of the blades about the axis of rotation of the propeller. The cyclic pitch is defined by a differential cyclic pitch angle over one revolution of the blades and by a cyclic angle. The differential cyclic pitch angle is defined as the difference between the maximum cyclic pitch angle and the minimum cyclic pitch angle of a blade over the course of one revolution. The collective pitch is the mean cyclic pitch angle. The cyclic angle is the angle formed, about the axis of rotation of the propeller, between the direction in which the pitch angle of the blades is at a maximum and a reference direction linked to the body of the vehicle. Neutral collective pitch is the name given to the pitch angle of the blades at which the propeller rotating about its axis of rotation exerts a zero thrust along its axis of rotation. The neutral cyclic pitch is that at which the blades exert a thrust whose component perpendicular to the axis of rotation of the propeller is zero. Coordinated controlling of the two propellers makes it possible to control the orientation of the thrust over $4\pi$ steradians.

Vectored thrusters formed of two coaxial counter-rotating propellers, that is to say the axes of rotation of which are substantially coincident, are known in particular. Coaxial propellers the axes of rotation of which are substantially parallel to the main axis of displacement of the vehicle are known, for example. The main axis of displacement of the vehicle is the axis, linked to the body of the vehicle, along which the vehicle is mainly intended to move. 'Axis linked to the body of the vehicle' is understood to mean that the orientation and the position of the body of the vehicle in a plane perpendicular to the axis are fixed. This type of thruster has the advantage of being able to be controlled in such a way as to have good energy efficiency at high speed. Thus, the two propellers generate a thrust that is naturally oriented along the main axis of displacement of the vehicle. Conventionally, but without limitation, the main axis of displacement of the vehicle is the roll axis of the vehicle. The yaw axis and the pitch axis are radial axes, that is to say perpendicular to the main axis, passing through the main axis.

The method is also applicable to thrusters of the type comprising two counter-rotating or non-counter-rotating propellers with variable collective and cyclic pitches, of which the axes of rotation of the propellers are separate and substantially parallel, and to those having propellers of which the axes of rotation are not parallel. Advantageously, for a vehicle intended to move mainly along a main axis, the axes of rotation of the propellers form arbitrary respective angles other than 90° with this axis, which is for example the main axis of displacement of the vehicle. More advantageously, the axes of rotation of the propellers are substantially parallel to the main axis of displacement of the vehicle, thereby making it possible to improve the propulsion efficiency during travel in a straight line along this axis. The rotational speed of the blades of the propeller about its axis of rotation (called rotational speed of the propeller) is able to be adjusted independently or collectively for the two propellers. The propellers may each have an orientation that is fixed with respect to the body of the vehicle. In other words, their respective axes of rotation are fixed with respect to the axis of the vehicle.

The method according to the invention also applies to thrusters comprising two orientable thrusters with a ball-joint link, also called gimbal propellers. These thrusters each have a propeller comprising blades the pitch of which is not able to be adjusted. As a variant, the cyclic pitch and/or the collective pitch may be variable. Each of the propellers is linked by a ball-joint link to the body of the marine vehicle, formed for example by way of a Cardan joint such that the plane of rotation (or the axis of rotation) of each of the propellers is able to pivot, with respect to the body of the vehicle, about two axes that are perpendicular to one another. In other words, the orientation of the propellers with respect to the body of the vehicle is able to be modified. The rotational speed of each of the propellers about its axis of rotation is also able to be adjusted, preferably independently of one another. A single thruster of gimbal propeller type has more limited efficiency than thrusters with counter-rotating propellers with a variable collective and cyclic pitch, and has an action that is limited to a given angular sector having an aperture of less than 360°.

The propellers may have the same diameter or a different diameter, the same number of blades or a different number of blades.

Figure 2:
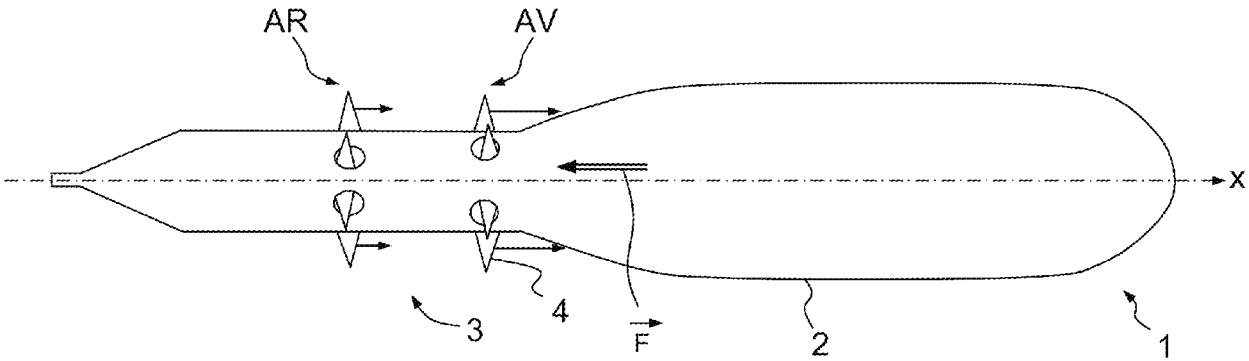
Figure 3:
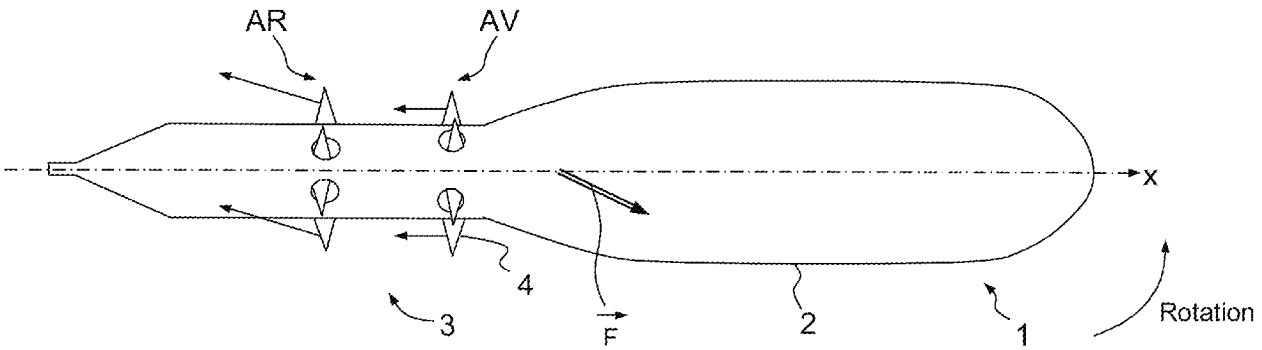

FIGS. 1 to 3 schematically show a plan view of an underwater vehicle 1 having a body 2 and a vectored thruster 3 mounted on the body of the underwater vehicle 1. This vehicle moves along an axis of displacement x in the direction of the axis x. The thruster 3 is of vectored thruster type, comprising two counter-rotating propellers AV, AR with variable collective and cyclic pitches. The propellers are coaxial. In other words, they are intended to rotate about axes of rotation that are substantially coincident. The axis x of the propellers is the axis of displacement of the vehicle. In the non-limiting example of the figures, the axis x is the preferred axis of displacement of the vehicle, which is in this case the roll axis of the vehicle. The axis of displacement x of the vehicle is oriented in the preferred direction of displacement of the vehicle when the vehicle has a preferred direction of displacement. The propellers comprise a front propeller AV and a rear propeller AR. The front and the rear, and the left and the right, are defined with respect to the axis of displacement x of the vehicle 1 in the direction of the axis x. The front propeller AV is the upstream propeller when the vehicle is moving forward along the axis x, and the rear propeller is then the downstream propeller. The front propeller AV is the downstream propeller when the vehicle is moving backward along the axis x, and the rear propeller is then the upstream propeller.

The blades of each propeller AV, AR are mounted on the body 2 of the vehicle 1 so as to rotate about the axis of rotation of the corresponding propeller AV, AR. The blades of a propeller are fixed so as to rotate about the axis of rotation of the propeller. For example, each blade is linked by an axis to a hub mounted so as to rotate on the body 2 of the underwater vehicle 1 about the axis of rotation of the propeller, generally defined by a shaft.

The lines of flows of water between the two propellers are represented by arrows. It is recalled that a flow generated by a propeller represents the speed of the water through the propeller. The modulus or intensity of the flow, expressed in $kg \cdot m \cdot s^{-1}$, is a rate of the amount of displacement of the water through the area of the propeller. The thrust force generated by the thruster is shown by a double arrow in each figure. In these figures, for greater clarity, the thrust is shown in the central part of the vehicle, but it is advantageously applied to a point of the body of the vehicle that is situated between the two propellers and preferably on the roll axis of the vehicle.

In the embodiment of the figures, the two propellers AV, AR are installed at the rear of the vehicle, that is to say on the rear half of the body of the vehicle along the reference axis x. As a variant, these two propellers are installed at the front of the body of the vehicle or one at the front and one at the rear of the body of the vehicle. To be able to rotate the vehicle, that is to say to displace the vehicle by generating a radial thrust, the planes of rotation of the propellers are not positioned in planes symmetrical to one another with respect to a plane containing the center of mass of the body 2 of the underwater craft 1.

The method according to the invention comprises what is termed a navigation step. In this step, the thruster is controlled such that each propeller generates a flow. In this step, as visible in FIGS. 1 and 3, the thruster 3 is controlled such that the propellers AV, AR generate rearward flows along the axis x. The flow generated by the thruster 3 is the combination of the flows generated by the two propellers AV, AR. In FIGS. 1 and 3, each of these flows is oriented rearward along the axis of displacement x of the vehicle. As a result, the thrust force $\vec{F}$ generated in reaction by the thruster 3 comprises a positive axial component (along the axis x). In other words, the vehicle moves along the axis x in the direction defined by the axis x. In this case, the front propeller AV is the upstream propeller and the rear propeller AR is the downstream propeller.

In FIG. 2, the thruster is controlled such that the propellers generate forward flows along the axis x. The flow generated by the thruster is the combination of the flows generated by the two propellers. This flow is oriented forward. The thrust force $\vec{F}$ generated in reaction by the thruster is directed rearward and the vehicle reverses in the direction of the axis x. In this case, the front propeller AV is the downstream propeller and the rear propeller AR is the upstream propeller.

As a result, in the navigation step, in order for the vehicle to move along the axis x in a predetermined direction, the thruster is controlled such that the propellers continuously generate flows directed downstream in said direction. Downstream is situated rearward when the vehicle is advancing along a predetermined direction in a predetermined direction, and upstream is situated forward of downstream when the vehicle is advancing along this direction in this direction.

As a variant, the vehicle could move along another axis of displacement linked to the vehicle, which may not be the axis of the propellers. In this case, the thruster would be controlled such that the flows generated by the propellers along the axis x are oriented in one and the same direction along the axis of displacement of the vehicle, and this direction would be opposite to the direction of displacement of the vehicle along this axis.

In the navigation step, each propeller advantageously generates a flow that is non-zero and directed in the same direction along the axis of rotation of the propeller, over the entire revolution of the blades of the propeller in the liquid about the axis of rotation of the propeller. In other words, the axial component of the flow has the same sign over the entire revolution of blades of the propeller in the liquid about the axis of rotation of the propeller. This means that the flow lines generated by the propeller in each radial angular sector that is fixed with respect to the body of the vehicle and swept by the propeller are oriented essentially in the same direction along the axis of rotation of the propeller. Each flow has a component that is non-zero and has the same sign along the axis of rotation of the propeller, over most of the revolution of the blades of the propeller in the liquid about the axis of rotation x of the propeller and preferably over the entire revolution of the blades of the propeller about the axis of rotation of the propeller. In other words, the thruster is controlled, for example by limiting the differential cyclic angle as a function of the applied collective pitch, such that each propeller generates a thrust in the same direction over most of the revolution of the blades of the propeller about the axis of rotation, and preferably over the entire revolution of the blades of the propeller about the axis of rotation of the propeller. The fact that each flow essentially has the same direction over the entire revolution of the blades of the propeller in the liquid about the axis of rotation makes it possible to avoid the creation of vortices between the propellers that would destabilize the vehicle. As a variant, the direction of the flow along the axis of rotation of at least one propeller does not have the same sign over the entire revolution of the blades of the propeller in the liquid about the axis of rotation of the propeller.

In FIGS. 1 and 2, the flows generated by the two propellers AV, AR are rotationally symmetrical about the axis of displacement x. As a result, the flow generated by the thruster 3, which flow is the combination of the flows generated by the two propellers, is rotationally symmetrical about the axis x. As a result, the thruster generates an axial thrust, but no radial thrust. The axial thrust is the component of the thrust generated by the thruster along the axis of displacement x. The radial thrust is the component of the thrust generated by the thruster along an axis perpendicular to the axis of displacement x. The vehicle does not undergo rotation about an axis perpendicular to the axis of rotation of the propeller.

The thruster is configured (in other words, the properties of each propeller and the arrangement between the propellers are chosen) such that the flow generated by each propeller is able to reach the other propeller or at least that the flow generated by the upstream propeller is able to reach the downstream propeller. This configuration is valid over a predetermined range of speeds, advantageously being the range of speeds over which the vehicle is intended to navigate with respect to the liquid.

In FIG. 3, showing a vehicle at an instant t, the thruster 3 is controlled so as to rotate the vehicle about an axis perpendicular to the axis of displacement x. In this figure, the vehicle is advancing along the axis x and rotates about the axis x. In order for the vehicle to advance along the axis x, the orientation of the flows generated by the two propellers along the axis of displacement x are the same as in FIG. 1. To pivot the vehicle about an axis perpendicular to the axis of displacement x in the navigation step, the thruster 3 is controlled such that the downstream propeller (in this case the rear propeller AR) generates a flow that is not rotationally symmetrical about the axis of displacement x. In other words, the thruster is controlled such that the downstream propeller (in this case the rear propeller) generates a downstream flow the main axis $\vec{T}$ of which, shown in thin lines with respect to the arrows representing the flow lines, forms a non-zero angle with the axis x. In FIG. 3, the flow generated by the upstream propeller (in this case the front propeller) at an instant t is still rotationally symmetrical about the axis x. The total flow generated by the thruster 3 is no longer rotationally symmetrical about the axis x. The thrust $\vec{F}$ generated by the thruster has a non-zero radial component in the plane of the page of FIG. 3, and the vehicle will then be driven, under the effect of the thrust, in a turning motion about an axis perpendicular to the plane of the page in the direction of the curved arrow showing the rotation of the vehicle. In the example of FIG. 3, if it were necessary to show the joining point between the axis of rotation of the vehicle perpendicular to the page and the plane of the page, it would be shown at the top right of FIG. 3, outside the vehicle. If the vehicle rotates in the direction of the curved arrow representing the rotation of the vehicle, then if the flow generated by the upstream propeller (in this case the front propeller AV) at the instant t is directed toward the position of the center of the downstream propeller (in this case the rear propeller AR) at the instant t, that is to say if the main axis of the upstream flow generated by the upstream propeller (in this case the front propeller AV) comprises the position of the center of the downstream propeller (in this case the rear propeller AR) at the instant t, this flow arrives at the downstream propeller off-centered with respect to the axis of rotation of the downstream propeller (in this case the rear propeller AR). 'Main axis of the flow generated by a propeller' is understood to mean the axis passing through the center of the propeller and the direction of which is the direction of the flow generated by the propeller. The direction of the main axis is defined with respect to the body of the vehicle. 'Center of a propeller' is understood to mean a predetermined point of the propeller situated on or substantially on the axis of rotation of the propeller and inside the volume that the propeller is able to sweep over one revolution of the blades of the propeller about the axis of rotation of the propeller. This volume includes the axis of rotation of the propeller. This point is called center of the propeller. It is a center of mass of the propeller, for example. The center of mass of a propeller may advantageously be defined as the center of mass of the blades.

Figure 4:
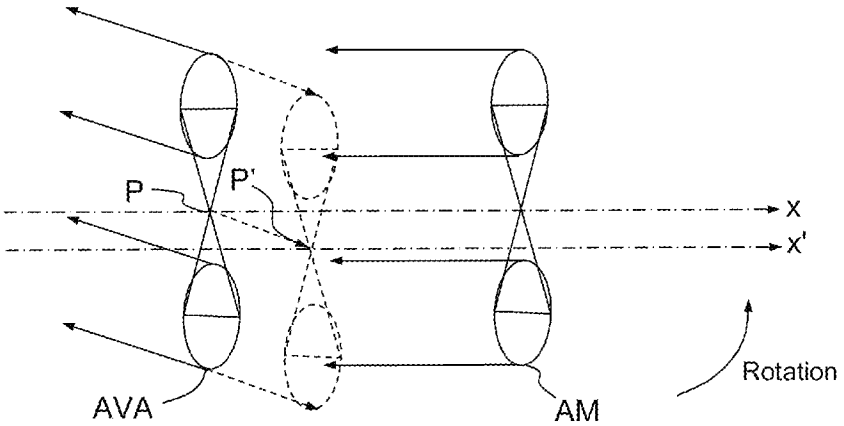

FIG. 4 illustrates, with more precision, the positions of the propellers and of the flows of FIG. 3 at the instant t. FIG. 4 shows, in unbroken lines, the positions of the upstream propeller AM, which is the front propeller AV of FIG. 3, and of the downstream propeller AVA, which is the rear propeller AR in FIG. 3, at an instant t at which the propellers are generating the flows shown in FIGS. 3 and 4. Flow lines generated by the two propellers are represented by solid arrows in FIG. 4. The flow generated by the downstream propeller AVA makes the vehicle 1 rotate in the direction of the curved arrow representing the rotation about an axis perpendicular to the plane of the page. The flow generated by the upstream propeller AM at the instant t is directed toward the position P occupied by the center of the downstream propeller at the instant t. The position of the downstream propeller AVA when the flow of the upstream propeller reaches it is shown in dashed lines. The two positions of the downstream propeller are linked by arrows formed of dotted lines. It is seen that the flow generated by the upstream propeller AM is not rotationally symmetrical about the position of the axis of rotation x' of the downstream propeller at the instant t+dt. This has the effect of disrupting the angle of incidence of the blades of the downstream propeller for a given pitch angle. The angle of incidence defines the orientation of the propellers with respect to the liquid. When the pitch angle of the blades is disrupted, the thruster then produces a thrust different from the desired thrust, which may range as far as the opposite of the desired thrust. The path of the vehicle is then deviated, and the vehicle may start to vibrate.

Figure 5:
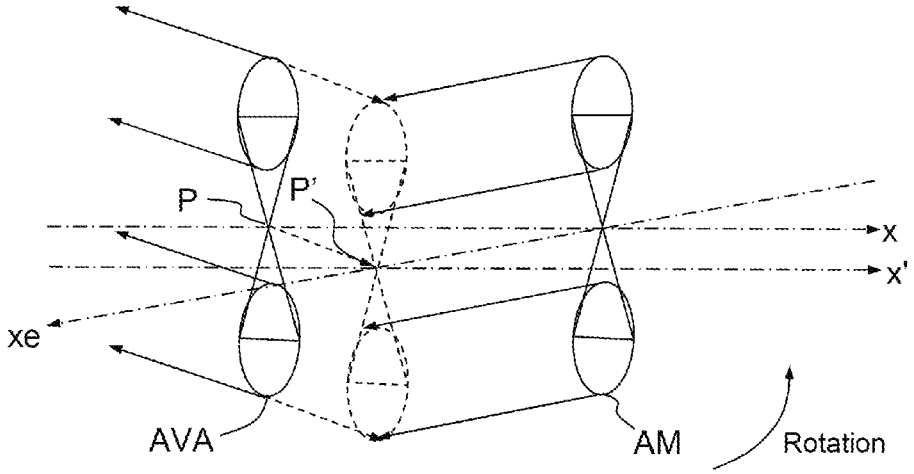

As shown in FIG. 5, the navigation step comprises a step of stabilizing the vehicle according to the invention. In this step, when the vehicle 1 is moving along a predetermined axis of displacement x, for example linked to the body 2 of the vehicle 1, in a predetermined direction (in this case the direction of the axis x) and rotates about at least one axis perpendicular to the axis x with a rotational speed (which may be zero), the thruster 3 is controlled such that the main axis of the upstream flow generated by what is termed the upstream propeller AM at a given instant t is an estimated main axis xe (or estimated main axis xe) on which a position P' of the center of the downstream propeller AVA is assumed, that is to say estimated, to be situated at a later instant t+dt at which the flow generated by the upstream propeller AM reaches the downstream propeller AVA.

In other words, the upstream propeller is controlled such that the upstream flow generated by the upstream propeller at the instant t is substantially centered on the center of the downstream propeller at the instant at which the flow generated by the upstream propeller reaches the downstream propeller. The main axis of the flow generated by the upstream propeller AM, in relation to the body of the vehicle, is defined such that the upstream flow generated by the upstream propeller AM continues to reach the downstream propeller in a manner substantially centered on the center of the downstream propeller AVA, even when the vehicle is turning. In other words, the main axis of the upstream flow generated by the upstream propeller AM at a given instant t is defined so as to pass substantially through the center of the downstream propeller at the instant t+dt. Thus, the method according to the invention may comprise a step of determining the estimated main axis. In other words, this step is a step of estimating an axis on which the position P' of the center of the downstream propeller AVA is situated at the instant t+dt. The method then comprises a step of controlling the upstream propeller such that the main axis of the upstream flow generated by what is termed the upstream propeller AM at a given instant t is the estimated axis.

The estimated main axis may be depend on one or more variables listed below. In other words, the estimated main axis may be determined from one or more of these variables. In other words, the axis along which the center of the downstream propeller is located at the instant t+dt may be estimated from one or more of these variables. This is carried out in a step of determining the estimated axis.

The estimated main axis, and more particularly the direction of the estimated axis with respect to the upstream propeller, advantageously depends on the rotational speed of the vehicle. The estimated main axis passes through the center of the upstream propeller. In other words, the axis along which the position of the downstream propeller is estimated to be at the instant t+dt passes through the upstream propeller. The rotational speed of the vehicle is a rotational speed with respect to a fixed reference frame, for example the liquid (outside of the flow generated by the thruster) or the terrestrial reference frame.

Advantageously, the estimated main axis depends on a speed of displacement of the vehicle with respect to a fixed reference frame along the axis of displacement. The fixed reference frame, for example the liquid in the vicinity of the vehicle outside of the flow generated by the thruster or the terrestrial reference frame.

Advantageously, the estimated main axis depends on the flow generated by the upstream propeller.

Advantageously, the estimated main axis is determined from the rotational speed of the vehicle.

Advantageously, the estimated main axis is determined from a speed of the liquid entrained by the flow generated by the upstream propeller, in relation to the body of the vehicle. The speed of the liquid entrained by the flow in relation to the body 2 depends on the flow generated by the upstream propeller and on the speed of displacement of the vehicle with respect to the liquid.

The estimated main axis is advantageously determined from the distance between the centers of the two propellers.

The estimated main axis xe is determined from the rotational speed of the vehicle and from the flow generated by the upstream propeller, with respect to the body of the vehicle.

In other words, the direction of the flow generated by the upstream propeller AM, in relation to the body of the vehicle, is advantageously obtained from the rotational speed of the vehicle 1, possibly accommodating its linear rate of advance (a phenomenon linked to a rotating reference frame joined to the vehicle called the Coriolis force) and possibly the value of the flow generated by the upstream propeller, so that the upstream flow generated by the upstream propeller AM continues to reach the downstream propeller in a manner substantially centered on the center of the downstream propeller AVA, even when the vehicle is turning.

FIG. 5 differs from FIG. 4 in that the upstream flow generated by the upstream propeller AM is directed toward an estimated position P' of the center at an instant t+dt at which the flow generated by the upstream propeller AM has propagated as far as the downstream propeller AVA. In other words, the main axis of the flow generated by the upstream propeller is an estimated main axis comprising the estimated position P'. In this way, the blades of the downstream propeller AVA, receiving the flow generated by the upstream propeller AM, sweep a homogeneous flow over their entire revolution about the axis of rotation of the downstream propeller, thereby allowing the path of the vehicle to be controlled, in particular when turning, with optimal efficiency at medium and high speed and above all without the occurrence of thrust vibrations linked to the modulation of the angle of attack of the blades of the downstream propeller by the vorticity of the flow of the upstream propeller that is not centered on the center of the downstream propeller. Moreover, this control method allows the device to be maneuvered solely using the thruster. The use of jets of water or of fins in addition to the thruster is not required, which is advantageous in terms of energy (low hydrodynamic drag), in terms of mass, in terms of simplicity, in terms of maneuverability of the vehicle, regardless of the speed of the vehicle even when reversing, and in terms of effectiveness of the maneuver, even at high speed.

In the step of stabilizing the vehicle, the propellers are controlled as described above with reference to FIGS. 1 to 3 so as to obtain a desired translational displacement along the axis of displacement x and a desired rotational displacement along an axis perpendicular to the axis of rotation. In other words, as the vehicle moves along the axis of displacement, the stabilization step is implemented while the thruster is controlled such that the upstream and downstream propellers generate flows that are oriented downstream along the axis of displacement x of the vehicle. The combination of the flows generated by the two propellers makes it possible to obtain an upstream axial thrust force in all of the radial directions (defined with respect to the axis x), this being the case regardless of the axial speed of the vehicle as long as there is a flow that makes it possible to distinguish between upstream and downstream.

The thruster may be controlled such that the flow generated by the downstream propeller is not rotationally symmetrical about the axis of displacement x of the vehicle, so as to generate the axial thrust allowing the vehicle to rotate about a radial axis.

Figure 6:
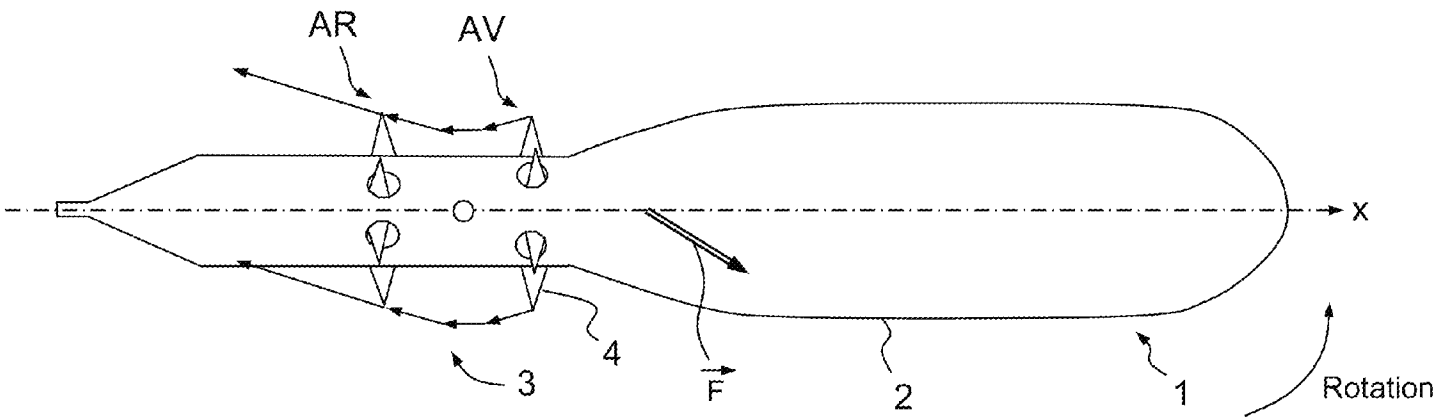

FIG. 6 differs from FIG. 3 through the direction of the flow generated by the upstream propeller (in this case front propeller AV) at the instant t in relation to the body of the vehicle. This flow is directed along the estimated main axis xe described above. In other words, the main axis of this flow is the estimated main axis. The lines of the upstream flow generated by the upstream propeller (in this case the front propeller AV) at the instant t and propagating until the instant t+dt are shown in FIG. 6. It is seen that, by directing the upstream flow along the estimated main axis xe, that is to say by not directing the upstream flow generated by the upstream propeller (in this case the front propeller AV) at the instant t toward the position occupied by the center of the downstream propeller at the instant t, this flow arrives homogeneously over the entire revolution of the blades of the downstream propeller about the axis of rotation of the downstream propeller at the instant t+dt.

The estimated main axis xe, and in particular the direction of the estimated main axis with respect to the upstream propeller, is possibly defined on the basis of the rotational speed of the vehicle about at least one perpendicular axis and possibly on the basis of a speed of liquid in the upstream flow generated by the upstream propeller in relation to the body 2 of the vehicle 3.

The rotational speed of the vehicle is advantageously measured by way of at least one sensor. The rotational speed may be obtained from at least one gyrometer housed on board the vehicle, for example in an inertial system.

The speed of the liquid entrained by the upstream flow in relation to the body 2 of the vehicle 1 may be a three-dimensional speed or, more simply, a speed of the liquid with respect to the vehicle along the reference axis. This speed may be measured by way of at least one sensor. For example, this speed is measured by way of a sensor, for example a flow rate sensor, that allows the modulus of this speed and possibly an orientation of the speed of the liquid to be measured. As a variant, the speed of the liquid is an estimation of the speed of the liquid entrained by the flow generated by the upstream propeller in relation to the vehicle. The estimated speed is determined for example from the rotational speed and collective and cyclic pitch angles of the upstream propeller and possibly of the downstream propeller. It may also be determined from the electrical or mechanical measurement of the engine torque applied by the upstream propeller and/or by the downstream propeller and/or by the thruster to the vehicle. As a variant, it may be determined from a measurement of speed of the vehicle with respect to the liquid along the axis of displacement. Determining the speed through estimation is less accurate, but easier to perform and less expensive than direct measurement.

Figure 7:
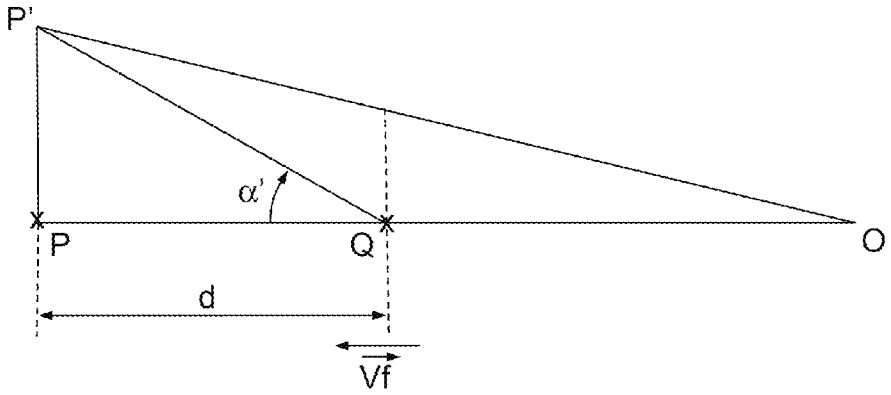
FIG. 7 illustrates an example of the calculation of the estimated main axis, FIG. 8 schematically shows, in a radial plane, the direction of the radial thrust exerted by the thruster as a function of the cyclic angle, FIG. 9 schematically shows a propulsion system of a vehicle according to the invention.

With reference to FIG. 7, a description will now be given of an example of calculation of the direction of the estimated main axis xe. This estimated main axis passes through a center of the upstream propeller. FIG. 7 shows the positions P and Q of the centers of the respective upstream and downstream propellers at the instant t, and the position O of the point of intersection between the axis of rotation of the vehicle (perpendicular to the page), about which axis the vehicle rotates at the rotational speed co, and the plane of the page. In this figure, the points P, Q and O are aligned. Also shown is an estimated position P' of the position of the center of the downstream propeller at the instant t+dt at which the flow generated by the upstream propeller at the instant t reaches the downstream propeller. The speed of the liquid entrained by the flow generated by the upstream propeller, with respect to the vehicle, is denoted Vf.

To within a good approximation, the estimated angle α' formed between the estimated main axis and the axis x linking the centers of the two propellers at the instant t+dt is given by the following formula:

$$\alpha' = \omega * \frac{d}{Vf}$$

where d is the distance between the centers of the two propellers.

In the stabilization step, the thruster is therefore controlled such that the flow generated by the upstream propeller is directed in the estimated direction forming an angle substantially equal to the estimated angle α' with the axis x, instead of directing this flow along the axis x. In other words, the thruster is controlled so as to correct, at the instant t, the direction of the main axis of the flow generated by the upstream propeller with respect to the direction linking the centers of the two propellers, such that the main axis is directed in the estimated direction.

When the rotational speed of the vehicle about the axes perpendicular to the axis of the propellers is zero, the thruster is controlled such that the flow generated by the upstream propeller at the instant t is directed toward the position of the center of the downstream propeller at the instant t.

Advantageously, the estimated main axis is determined from a distance between the downstream propeller and the axis of rotation of the vehicle about which the vehicle rotates. The distance between the downstream propeller and the axis of rotation is for example the distance between the center of the downstream propeller and the axis of rotation of the vehicle along an axis perpendicular to the axis of rotation of the vehicle.

In order to obtain an estimated main axis that is closer to the actual position of the center of the downstream propeller than the estimated main axis directed along the direction calculated from the data listed above, the estimated main axis (in particular the direction of this axis) furthermore depends on, or is determined from, an acceleration of the vehicle with respect to the water. This allows the control of the path of the vehicle to be improved. This acceleration may be obtained from one or more accelerometers housed on board the vehicle. It is possible to determine the estimated main axis from the linear acceleration of the vehicle (along the axis x linked to the vehicle) and/or from the radial acceleration (perpendicular to the axis) of the vehicle. These measurements modify the value of the speed Vf and the rotational speed ω, respectively.

In one embodiment of the invention, the stabilization step is implemented when the modulus of the speed of the vehicle in the axial direction is greater than a predetermined non-zero threshold. Another control method may then be used to control the vehicle when the modulus of the speed of the vehicle in the axial direction is less than the threshold, so as to allow better maneuverability of the vehicle at low speed.

Advantageously, the control method comprises the following pair of steps:

- a determination step comprising a step of determining the current rotational speed of the vehicle and possibly a step of determining the current speed of the liquid entrained by the upstream flow generated by the upstream propeller, in relation to the body of the vehicle,
- the step of stabilization on the basis of the determined value(s).

The stabilization step is furthermore advantageously carried out on the basis of the distance between the centers of the two propellers. In other words, the determination step advantageously uses this distance.

More precisely, the estimated axis is determined from the determined values and possibly from the distance between the centers of the two propellers.

This pair of steps is advantageously implemented at regular intervals of time.

The interval of time is for example between 1 s and 5 s. It may depend on the linear speed of the vehicle. It may be determined from a desired stability for the vehicle. As a variant, the stabilization step comprises the pair of steps implemented at least once.

This embodiment allows the direction of the flow generated by the upstream propeller to be corrected regularly at predetermined intervals of time, so as to prevent the vehicle from deviating from the path that it is desired to impose thereon. Only fast maneuvers carried out over a duration shorter than the selected time interval will not be able to benefit from this correction.

Advantageously, the stabilization step and/or the pair of steps is implemented when the linear speed of the vehicle along the axis of displacement is greater than the predetermined threshold.

Advantageously, the stabilization step or the pair of steps is not implemented when the rotational speed of the vehicle exceeds a predetermined rotational speed threshold. This threshold is at least equal to the rotational speed threshold at which the flow from the upstream propeller is not able to reach the downstream propeller, that is to say that the journey time for the generated flow between the upstream propeller and the downstream propeller is greater than the displacement time of the downstream propeller. In other words, the stabilization step is implemented as long as the rotational speed is less than or equal to the threshold.

Advantageously, as long as the rotational speed of the vehicle returns to a value less than or equal to this threshold, the stabilization step is implemented or the pair of steps is implemented again at predetermined intervals of time.

The step of determining the rotational speed of the vehicle comprises a step of measuring the rotational speed of the vehicle. The step of determining the speed of the liquid entrained by the upstream flow generated by the upstream propeller, with respect to the body of the vehicle, comprises for example a step of measuring the speed of the liquid in the upstream flow in relation to the vehicle or a step of measuring at least one variable and/or a step of determining this speed from the variable (or variables) and/or from the value of at least one current parameter. For example, the speed of the liquid is determined from the current cyclic and collective pitches of the blades of the upstream propeller and the current rotational speed of the upstream propeller and possibly the current cyclic and collective pitches of the blades of the downstream propeller and the current rotational speed of the downstream propeller. These data are parameters. The determination step is carried out using a measurement device comprising the required sensor(s) and/or using the control unit.

The stabilization step comprises a step of determining the estimated main axis of the flow generated by the upstream propeller from the value(s) determined in the determination step. This step is carried out using the control unit.

The stabilization step at the instant t is advantageously carried out on the basis of the main axis of the flow generated by the upstream propeller when the preceding configuration step is implemented.

The stabilization step furthermore comprises a step of determining the configuration of the thruster, so that the upstream propeller generates an upstream flow the main axis of which is the estimated main axis, and a step of adjusting the thruster according to this configuration. This adjustment step is carried out by way of an actuation device or actuator.

The step of controlling the thruster is advantageously a step of controlling the propellers or the upstream propeller.

If the thruster is of the type with two counter-rotating propellers with variable collective and cyclic pitches, the vehicle comprises a control device comprising an actuation device comprising at least one actuator allowing the collective pitch and the cyclic pitch of each of the propellers to be controlled. This is for example a magnetic device or a motorized device allowing the collective and cyclic pitches to be adjusted. In a non-limiting manner, this device comprises collective and cyclic swash plates. The configuration that is obtained comprises a collective pitch, a cyclic pitch and possibly a rotational speed of the upstream propeller or the variation of one or more of these parameters to be applied to the propeller between the instant t and the instant t+dt.

For a vehicle moving in translation along an axis of displacement that is the axis of the propellers of two coaxial propellers and rotating about a radial axis perpendicular to the axis of the propellers, it is sufficient to modify the main axis of the flow generated by the upstream propeller with respect to the axis of the propellers in order for the flow still to reach the downstream propeller. To this end, it is sufficient to adjust the cyclic pitch of the upstream propeller.

In the case of a thruster comprising two Cardan thrusters, the configuration comprises the orientation of the axis of the upstream propeller. In other words, the orientation of the upstream propeller is adjusted so as to obtain the desired configuration.

Figure 8:
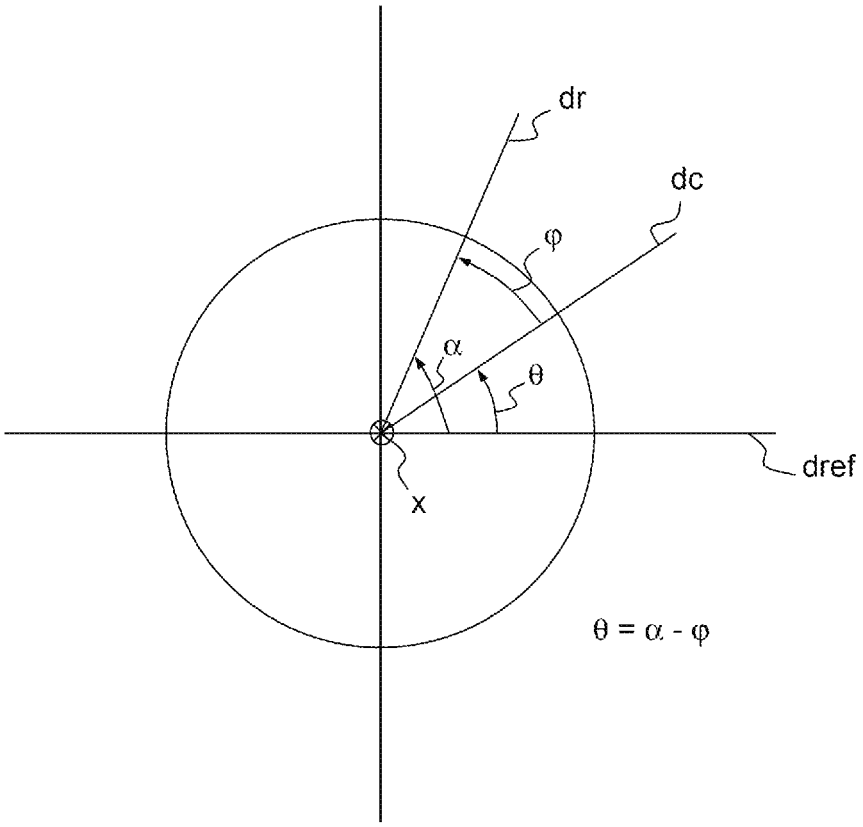
Figure 9:
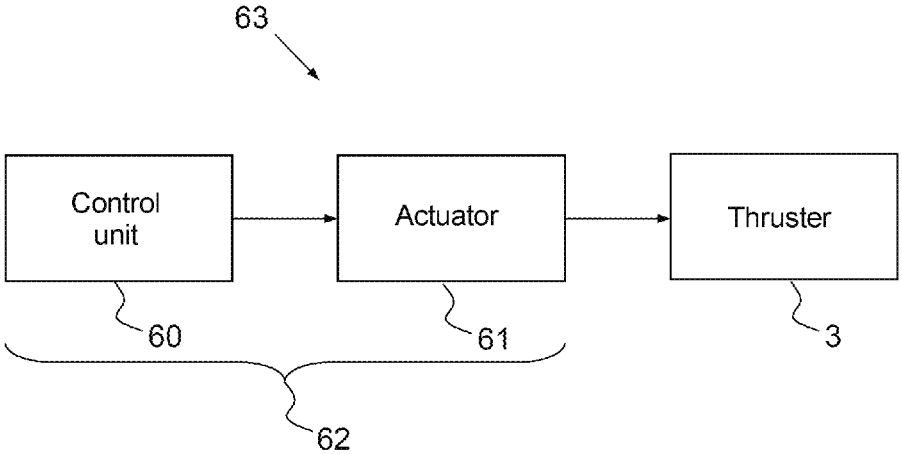

With reference to FIG. 8, a description will now be given of a particular method for adjusting the thruster, and more precisely the configuration of the downstream propeller, in order to obtain a radial thrust in a desired radial direction dr forming, in a reference frame linked to the body of the vehicle, about the axis of rotation of the downstream propeller, what is termed a predetermined thrust angle $\alpha$ with a reference direction dref. The thrust generated by the thruster may also comprise a non-zero axial thrust.

The thrust angle $\alpha$ is different from the cyclic angle of the downstream propeller. The radial thrust generated by the downstream propeller is directed in a radial direction dr forming, about the reference axis, an angle called the cyclic phase $\varphi$ with the direction dc in which the cyclic pitch angle of the downstream propeller. This cyclic phase $\varphi$ is, by symmetry, independent of the direction of the radial thrust generated by the thruster.

In order for the downstream propeller to generate a desired radial thrust exerted in the direction dr perpendicular to the axis of rotation of the downstream propeller, the cyclic pitch of the downstream propeller is adjusted by way of the following formula:

$$\theta=\alpha-\varphi$$

The corrected radial direction dc in which the cyclic pitch angle of the blades is at a maximum forms, about the axis of rotation of the downstream propeller, an angle $\theta$ with the reference direction dref. The cyclic pitch of the downstream propeller is non-neutral.

The cyclic phase $\varphi$ is advantageously determined in a preliminary calibration step. This calibration step comprises a measurement step comprising a first step of measuring forces and torques exerted by the vehicle on a test bench attached to the vehicle for several cyclic pitches of one or more propellers and/or a second step of measuring the direction of motion of the vehicle immersed in the liquid in an open area for several cyclic pitches of one or more propellers by way of gyrometers and accelerometers of the direction of motion of the underwater vehicle as a function of the cyclic pitch of the propellers. The calibration step furthermore comprises a step of calculating the cyclic phase from measurements carried out in the measurement step.

The invention also relates to a marine vehicle 2 such as described above, comprising a propulsion system 63. The propulsion system 63 comprises a control device 62 able to control the thruster 3 and configured to be able to implement the method according to the invention, and the thruster 3. The invention also relates to the propulsion system and to the control device.

The control device 62 comprises a control unit 60 that, upon receiving an instruction to implement the stabilization step, is configured to calculate a stabilization configuration into which the thruster should be put so that the main axis of the upstream flow is directed along the estimated main axis, possibly on the basis of at least one variable cited above, such as for example required speeds, and an actuation device or actuator 61 configured to control the thruster so as to configure the thruster according to said configuration. The control unit 60 may be implemented by way of software and/or hardware technology. The control unit 60 comprises for example a programmable logic component or a processor and an associated memory containing a program configured to determine the configuration. The processor and the memory may be grouped together within one and the same component, often called a microcontroller.

The actuator may comprise cylinders, which are for example electric or hydraulic, or a motor that actuates cables or chains and that makes it possible to move the point to which they apply their force, or else a rack and pinion in principle. The actuator is configured to tilt and/or move the collective and cyclic swash plates.

Advantageously, the control or command device 62 is configured, when it receives a navigation instruction comprising a thrust or a thrust direction to be applied by the thruster to the marine vehicle, to implement the navigation step according to the invention, such that the downstream propeller generates the thrust in the desired direction, and such that the two propellers generate flows in the downstream direction. The control step comprises a step of adjusting the two propellers.

The instructions may be generated on board the vehicle (autonomous vehicle) or outside the vehicle (remotely operated vehicle).

The invention claimed is:

1. A control method for controlling a thruster of a marine vehicle comprising a body and a thruster mounted on the body of the marine vehicle, the marine vehicle being at least partially immersed in a liquid and moving with respect to the liquid along an axis of displacement in a direction of displacement and rotating about at least one axis of rotation perpendicular to the axis of displacement with a rotational speed, the thruster comprising an upstream propeller and a downstream propeller along the axis of displacement in the direction of displacement, wherein the method comprises a stabilization step of the marine vehicle, in which an upstream flow generated by the upstream propeller at a given instant t is substantially centered on a center of the downstream propeller at an instant at which the upstream flow generated by the upstream propeller reaches the downstream propeller.

2. The control method as claimed in claim 1, wherein, in the stabilization step, the thruster is controlled such that each of the upstream propeller and the downstream propeller generate a flow that is directed downstream.

3. The control method as claimed in claim 1, wherein the thruster comprises two counter-rotating propellers with variable collective and cyclic pitches.

4. The control method as claimed in claim 1, wherein axes of rotation of the upstream propeller and the downstream propeller are substantially coincident.

5. The control method as claimed in claim 1, wherein, in the stabilization step, in order that the thruster exerts a radial thrust so as to rotate the marine vehicle about an axis perpendicular to the axis of displacement, the thruster is controlled such that the downstream propeller generates a flow that is not rotationally symmetrical about the axis of displacement.

6. The control method as claimed in claim 1, wherein, in order that the thruster generates a thrust having a radial component exerted in a direction dr, forming, about an axis of rotation of the downstream propeller, a first angle $\alpha$ with a reference direction, the thruster is controlled such that the downstream propeller has a cyclic pitch comprising a cyclic angle $\theta$ given by the following formula:

$$\theta=\alpha-\varphi$$

where a cyclic phase $\varphi$ is an angle formed, about the axis of rotation of the downstream propeller, between a thrust generated by the downstream propeller and the cyclic angle;

the cyclic angle being an angle formed, about the axis of rotation of the downstream propeller, between a direction in which a cyclic pitch angle of the propeller is at a maximum and the reference direction.

7. The control method as claimed in claim 1, wherein the cyclic phase is determined in a calibration phase.

8. The control method as claimed in claim 1, wherein during the stabilization step of the marine vehicle, the thruster is controlled such that a main axis of the upstream flow generated by the upstream propeller at the given instant t is an estimated main axis on which a position of a center of the downstream propeller, situated substantially on the axis of rotation of the downstream propeller, is estimated to be situated at a later instant t+dt at which the upstream flow generated by the upstream propeller at the given instant t reaches the downstream propeller.

9. The control method as claimed in claim 8, wherein the estimated main axis depends on the rotational speed of the marine vehicle.

10. The control method as claimed in claim 8, wherein the estimated main axis depends on a speed of displacement of the marine vehicle with respect to the liquid along the axis of displacement.

11. The control method as claimed in claim 8, wherein the estimated main axis is determined from the rotational speed of the marine vehicle and from a speed of the liquid entrained by the upstream flow generated by the upstream propeller, in relation to the body of the marine vehicle.

12. The control method as claimed in claim 8, wherein the estimated main axis is determined from a distance between a center of the upstream propeller and the center of the downstream propeller.

13. The control method as claimed in claim 8, wherein the estimated main axis is determined from an acceleration of the marine vehicle along the axis of displacement.

14. The control method as claimed in claim 8, comprising the following pair of steps implemented at predetermined intervals of time:

a determination step, comprising a step of determining the rotational speed of the marine vehicle, the step of stabilization depending on a value determined in the determination step.

15. The control method as claimed in claim 8, wherein the determination step comprises a step of determining a current speed of the liquid entrained by the upstream flow generated by the upstream propeller with respect to the body of the marine vehicle.

16. A control device for controlling a thruster of a marine vehicle comprising a body and a thruster mounted on the body of the marine vehicle, the marine vehicle being intended to be at least partially immersed in a liquid and moving with respect to the liquid along an axis of displacement in a direction of displacement and rotating about at least one axis of rotation perpendicular to the axis of displacement with a rotational speed, the thruster comprising an upstream propeller and a downstream propeller along the axis of displacement in the direction of displacement, wherein the control device being configured to control the thruster such that an upstream flow generated by the upstream propeller at a given instant t is substantially centered on a center of the downstream propeller at an instant at which the upstream flow generated by the upstream propeller reaches the downstream propeller for stabilizing the marine vehicle.

17. A marine vehicle comprising a control device as claimed in claim 16, the marine vehicle comprising the body and the thruster.

18. The control device as claimed in claim 16, wherein the control device being configured to control the thruster such that a main axis of the upstream flow generated by the upstream propeller at the given instant t is an estimated main axis on which a position of a center of the downstream propeller, situated substantially on the axis of rotation of the downstream propeller, is estimated to be situated at a later instant t+dt at which the upstream flow generated by the upstream propeller at the given instant t reaches the downstream propeller, the control device comprising a control unit for estimating the main axis and an actuation device for controlling the upstream propeller such that the main axis of the upstream flow generated by the upstream propeller at the given instant is the estimated main axis, for stabilizing the marine vehicle.

19. The control device as claimed in claim 18, wherein the estimated main axis depends on the rotational speed of the marine vehicle.

20. The control device as claimed in claim 18, wherein the estimated main axis depends on a speed of displacement of the marine vehicle with respect to the liquid along the axis of displacement.

21. The control device as claimed in claim 18, wherein the estimated main axis is determined from the rotational speed of the marine vehicle and from a speed of the liquid entrained by the upstream flow generated by the upstream propeller, in relation to the body of the marine vehicle.

22. The control device as claimed in claim 18, wherein the estimated main axis is determined from a distance between-a center of the upstream propeller and the center of the downstream propeller.

23. The control device as claimed in claim 18, wherein the estimated main axis is determined from an acceleration of the marine vehicle along the axis of displacement.

24. The control device as claimed in claim 18, wherein the control device is configured to implement the following pair of steps at predetermined intervals of time:

a determination step, comprising a step of determining the rotational speed of the marine vehicle, and the step of stabilization depending on a value determined in the determination step.

25. The control device as claimed in claim 18, wherein the control device is configured to implement a determination step that comprises a step of determining a current speed of the liquid entrained by the upstream flow generated by the upstream propeller with respect to the body of the marine vehicle.

26. The control device as claimed in claim 18, wherein the control device is configured to implement a stabilization step in which the thruster is controlled such that each of the upstream propeller and the downstream propeller generate a flow that is directed downstream.

27. The control device as claimed in claim 18, wherein the thruster comprises two counter-rotating propellers with variable collective and cyclic pitches.

28. The control device as claimed in claim 18, wherein axes of rotation of the upstream propeller and the downstream propeller are substantially coincident.

29. The control device as claimed in claim 18, wherein the control device is configured to implement a stabilization step in order that the thruster exerts a radial thrust so as to rotate the marine vehicle about an axis perpendicular to the axis of displacement and to control the thruster such that the downstream propeller generates a flow that is not rotationally symmetrical about the axis of displacement.

30. The control device as claimed in claim 18, wherein, in order that the thruster generates a thrust having a radial component exerted in a direction dr, forming, about the axis of rotation of the downstream propeller, a first angle $\alpha$ with a reference direction, the control device is configured to control the thruster such that the downstream propeller has a cyclic pitch comprising a cyclic angle $\theta$ given by the following formula:

$$\theta=\alpha-\varphi$$

where a cyclic phase $\varphi$ is an angle formed, about the axis of rotation of the downstream propeller, between a thrust generated by the downstream propeller and the cyclic angle;

the cyclic angle being an angle formed, about the axis of rotation of the downstream propeller, between a direction in which a cyclic pitch angle of the propeller is at a maximum and the reference direction.

31. The control device as claimed in claim 18, wherein the cyclic phase is determined in a calibration phase.

32. A propulsion system comprising the control device as claimed in claim 18 and the thruster.

33. The marine vehicle comprising the control device as claimed in claim 18, the marine vehicle comprising the body and the thruster.

34. The marine vehicle as claimed in claim 33, wherein the estimated main axis is determined from a rotational speed of the marine vehicle and from a speed of the liquid entrained by the flow generated by the upstream propeller, with respect to the body of the marine vehicle.

35. A propulsion system comprising the control device as claimed in claim 16 and the thruster.

* * * * *